United States Patent [19]

Hsu

[11] Patent Number: 4,510,784

[45] Date of Patent: Apr. 16, 1985

[54] ROLLING MILL SPRAY BAR

[75] Inventor: Yu-Wen Hsu, Livermore, Calif.

[73] Assignee: Kaiser Aluminum & Chemical Corporation, Oakland, Calif.

[21] Appl. No.: 540,964

[22] Filed: Oct. 11, 1983

[51] Int. Cl.[3] ..... B21B 27/10; B21B 45/02

[52] U.S. Cl. ..... 72/201; 239/436; 239/551; 239/563

[58] Field of Search ..... 72/44, 45, 201, 236, 72/32, 35; 239/436, 550, 551, 563

[56] References Cited

U.S. PATENT DOCUMENTS

| | | | |
|---|---|---|---|
| 804,807 | 11/1905 | Glore | 239/551 X |
| 1,994,721 | 3/1935 | Lorig et al. | 72/201 |
| 2,257,605 | 9/1941 | Hartley | 239/563 |
| 2,994,482 | 8/1961 | Valois et al. | 239/563 X |
| 3,182,867 | 5/1965 | Barosko et al. | 239/563 X |
| 3,237,872 | 3/1966 | Mincy | 239/551 X |
| 3,880,358 | 4/1975 | Schaming | 239/551 |
| 4,247,047 | 1/1981 | Schaming | 72/201 X |
| 4,400,961 | 8/1983 | Schaming | 72/201 |
| 4,418,559 | 12/1983 | Huzyak | 72/201 |

*Primary Examiner*—E. Michael Combs
*Attorney, Agent, or Firm*—Andrew E. Barlay

[57] ABSTRACT

A device for applying coolant/lubricant to the surface of the rolls of the rolling mill and/or the workpiece being rolled. The device comprises a housing having a plurality of nozzles associated therewith, a rotating inner manifold having a plurality of apertures therein in a particular array for directing liquid to the nozzles and sealing means between the manifold and housing which provides a leak-free passageway for the liquid. The manifold is rotated to align the apertures therein with the leak-free passageway to supply liquid to the desired nozzles.

5 Claims, 8 Drawing Figures

ROLLING MILL SPRAY BAR

BACKGROUND OF THE INVENTION

This invention generally relates to the rolling of metal ingots into sheet and plate products and in particular to an improved liquid application device or spray bar for the application of lubricants or coolants onto the surfaces of the workpiece or the work rolls or the backup rolls of a rolling mill, during the rolling process.

In the rolling of metal products, lubricants or coolants (hereinafter "liquids"), are applied to the workpiece or the work rolls or the backup rolls, or all three, to control both the temperatures and the frictional properties of these surfaces. Usually, such liquids are applied at both the entry and exit sides of the rolling mill stand.

In commercial rolling mills the amount of liquid applied and the pattern of liquid distribution on the work rolls are controlled to obtain the thermal gradients which will ensure that the proper crown will be maintained on the work rolls. Without such temperature control, undesirable thermal gradients build up along the length of the roll causing differential thermal expansion which distorts the crown of the roll and which results in differential thickness reductions and tension differences across the width of the workpiece, i.e. unflat sheet or plate.

For most commercial rolling, liquids are directly applied to both the work rolls and backup rolls through a series of nozzles or clusters of nozzles disposed along the length of the rolls, and each of the nozzles or clusters of nozzles are supplied with liquid from a separate liquid source which has independently controlled valving means in order to provide the desired liquid distribution on the rolls.

Because of the harsh environment in which these spray devices are used, frequent malfunctions occur causing mill shutdowns or ineffective cooling of the workpiece, the work rolls or the backup rolls which often result in unflat products. The individual valving means can plug up due to the buildup or accumulation of particulate and other debris which frequently accompany the liquids, in which case little or no liquid passes through to an area of the work rolls which expands due to heat buildup. On the other hand the valving means can stick open in which case unwanted liquid flow continues to a particular area of the workpiece or rolls causing undesirable cooling. Generally, when the control valves are maintained in the area of the rolls and workpiece they are exposed to a very high probability of damage. The valving arrangement can be removed to a much safer location away from the rolling mill where the chances for damage can be significantly reduced, but this does not avoid having liquid sources and individual valving means for each particular nozzle or cluster of nozzles.

Ideally, commercial spray devices should be durable and have the flexibility to make changes in coolant or lubricant application which are required by changes in the rolling conditions or workpiece characteristics. As an example of the latter characteristic, in the operation of most rolling mills the workpieces have widely varying widths and in such cases the coolant spray to the work rolls must be controlled to the edge of the workpiece. Coolant on the work rolls beyond the edge of the workpiece is undesirable and should be terminated. Additionally, although there are usually other strip flatness control means provided in a rolling mill, control of the liquid distribution over the work rolls and backup rolls is often necessary to correct for or to minimize center buckles, quarter buckles and edge waviness in the workpiece. There have been prior spray devices which allow for a significant number of such changes in coolant or lubricant distribution across the rolls but they have usually not been very durable.

Examples of prior art devices are found in the following references:

| | |
|---|---|
| US 804,807 | US 3,941,611 |
| US 3,237,872 | US 4,081,141 |
| US 3,574,338 | US 4,247,067 |
| US 3,771,730 | US 4,312,377 |
| US 3,880,358 | |

It is against this background that the present invention was developed.

DESCRIPTION OF THE INVENTION

The present invention is directed to an improved liquid application system or spray bar device which is simple and durable, yet flexible enough to control the flow of liquids along the length of the work rolls or backup rolls of a rolling mill in a wide variety of rolling applications.

The spray bar device in accordance with the invention generally comprises an elongated housing which has a plurality of discharge nozzles or clusters of nozzles associated with the the housing which are disposed adjacent to the workpiece being worked or the rolls of the rolling mill. A rotating manifold or header is provided within the exterior housing which has a plurality of ports or apertures in the arcuate wall thereof in a prearranged array corresponding to the nozzles or groups of nozzles associated with the exterior of the housing. Liquid can be directed with this device from a chamber defined in part by the rotating manifold through conduits provided in the housing to each of the desired nozzles or groups of nozzles. Sealing means, preferably low friction sealing means, are provided between the outer surface of the arcuate wall of the manifold and to provide a sealed liquid passageway therebetween so that no undesirable leakage occurs to nozzles or groups of nozzles which should be closed off.

The apertures in the arcuate, preferably cylindrically shaped, wall of the rotating manifold are provided in a particular arrangement or array so that, as the manifold is axially rotated, the holes in the wall of the manifold become aligned or in register with the conduits which are in fluid communication with the nozzles or clusters of nozzles associated with the exterior of the header. The particular array of apertures in the manifold wall is designed so that, when the manifold is rotated about its axis, the apertures therein which allow the passage of liquid from within the manifold to the nozzles, are opened or closed, as the case may be, to provide the desired liquid spray pattern required for the particular situation involved in the rolling mill.

Only about 10 to 30 separate liquid application patterns are needed in the operation of most commercial rolling mills so the size, the number and the location of apertures in the wall of the manifold can be readily determined. In its simplest form, all of the apertures in the manifold wall for a particular nozzle or group of nozzles are spaced radially from one point on the longitudinal axis of the manifold so that, when the manifold is rotated, coolant can flow from the chamber, defined in part by the manifold, through the aperture in the cylindrical wall thereof to the desired nozzle or group of nozzles only when the apertures in the manifold are in alignment or in register with the conduits which are in fluid communication with the nozzles or clusters of nozzles in the housing. To increase the number of possible combinations of liquid application patterns for a particular manifold diameter, the apertures in the manifold for each nozzle can be slightly skewed so that they rotate in a helical fashion about the axis of the manifold when the manifold is rotated to allow more apertures to be utilized for each particular nozzle or groups of nozzles. However, in this latter case the manifold must also be moved along its longitudinal axis to ensure proper alignment of the apertures in the manifold with the conduits leading to the nozzles.

The sealing means disposed between the manifold wall and the conduits in fluid communication with the nozzles can be a singular element such as a sleeve which slidably fits over the manifold and which has a plurality of apertures or ports through which the fluid passes to the various nozzles or the sealing means can be a plurality of individual sealing elements which are positioned between the apertures in the manifold associated with a particular nozzle or group of nozzles and the port in the exterior housing which is in fluid communication with a particular nozzle or groups of housing nozzles. The sealing element and the surface of the cylindrically shaped manifold wall are urged together and preferably are provided with matching curved shapes (i.e. one concave and one convex) so that a proper liquid tight seal can be made. Sealing means can be formed of any suitable material but a coating of polytetrafluoroethylene or other material having a low coefficient of friction is recommended for the surface of the sealing means which is in contact with the matching curved surface of the manifold.

The manifold is journaled or otherwise mounted so that it may be rotated within the housing and it is provided with a suitable drive means to rotate the manifold and thereby align the apertures in the wall thereof to be in fluid communication with the nozzles or groups of nozzles selected.

The operation of the spray bar device of the invention is amenable to automatic control, particularly control based on sensing devices which determine the unflatness of the workpiece downstream from the spray bar. Suitable flatness sensing devices include various types of shape meters and tensiometers which generate one or more signals representing the flatness or unflatness of the sheet or strip and which can be used by control procedures well known to those in the art to control the drive means which rotates the manifold of the spray bar of the invention. A particularly suitable flatness sensing device and method is disclosed in the inventor's copending application Ser. No. 537,868, filed on Sept. 30, 1983 for Process and Apparatus for Strip Flatness and Tension Measurements, which is hereby incorporated by reference in its entirety.

Reference is made to the drawings which illustrate embodiments of the invention.

Figure 1:
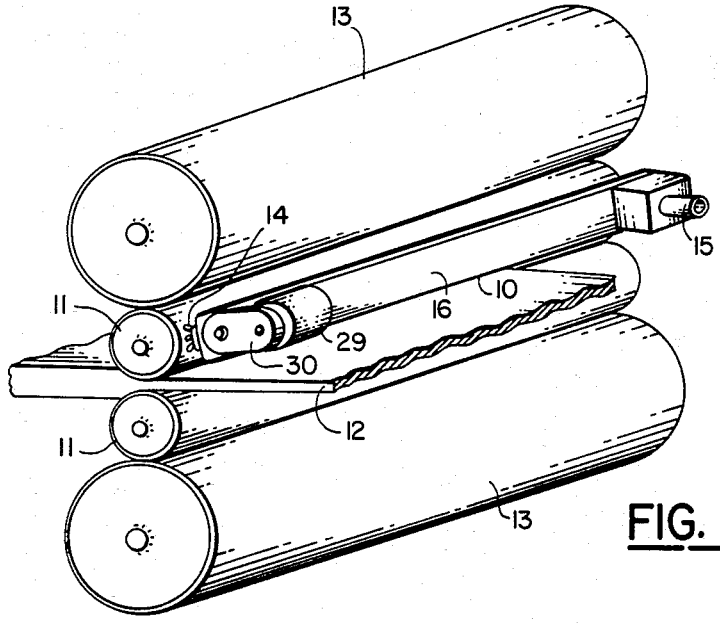
FIG. 1 is a perspective view of the spray bar of the invention disposed on the exit side of a rolling mill stand adjacent to the upper work roll 11.
Figure 2:
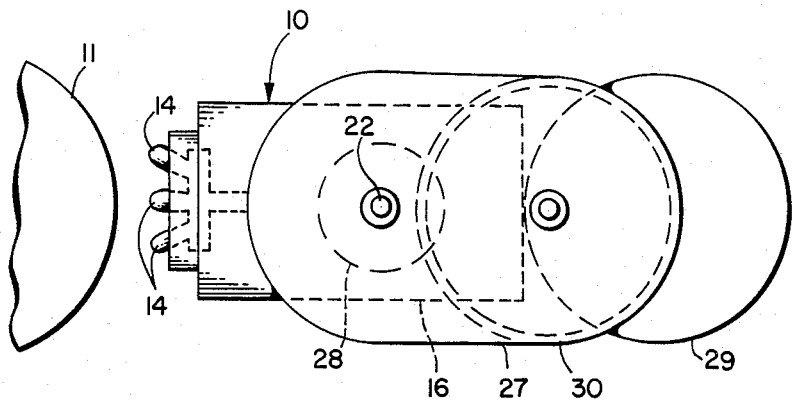
FIG. 2 is an end view of the spray bar.
Figure 3:
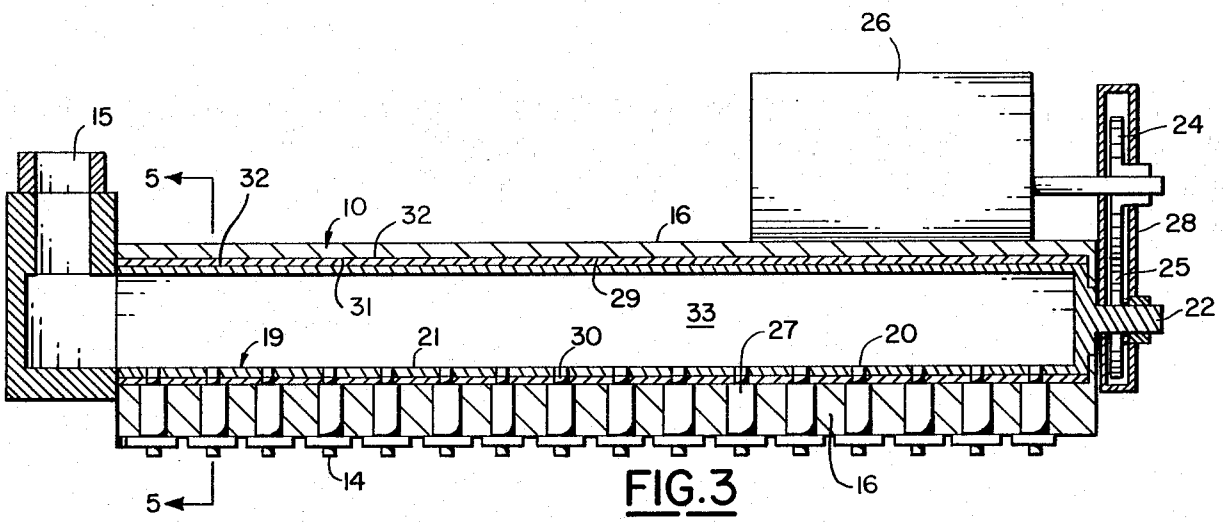
FIG. 3 is a top view of the spray bar in section.
Figure 4:
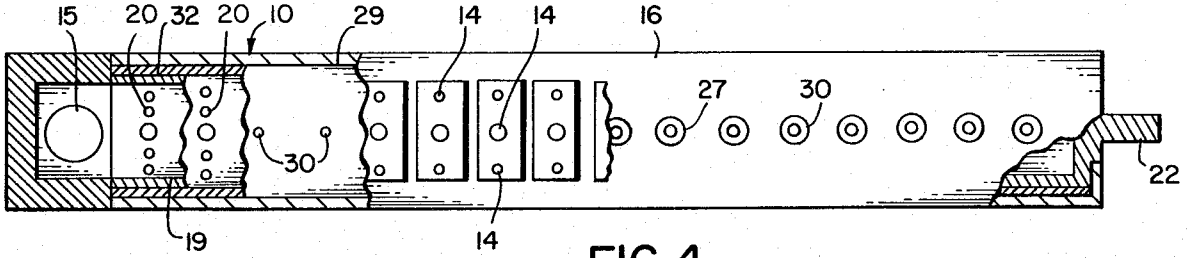
FIG. 4 is a rear view thereof partially in section.
Figure 5:
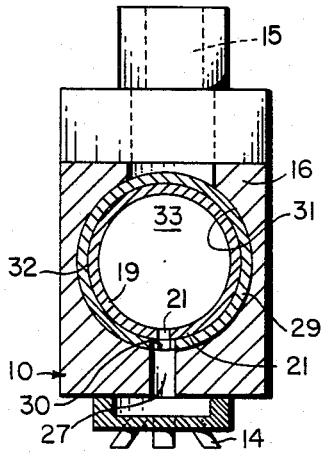
FIG. 5 is a cross sectional view taken along the lines of 5—5 shown in FIG. 3.

In FIG. 1 the liquid application device or spray bar 10 of the invention is suitably supported by means not shown on the exit side of a rolling mill stand, immediately adjacent to the upper work roll 11 and above the workpiece 12 exiting the mill stand. Liquid from spray bar 10 is sprayed onto the surfaces of the work roll 11. Separate spray bars (not shown) would be used to apply liquid to the lower work roll 11, the upper and lower back up rolls 13 and possibly the workpiece 12. Nozzles 14 spray liquid in the particular pattern desired onto the surfaces to be cooled. Conduit 15 directs liquid coolant and/or lubricant from a source (not shown) to the inside of the spray bar housing 16.

The internal and working details of the spray bar 10 are more completely illustrated in FIGS. 2–5 wherein the cylindrically shaped manifold 19 is shown rotatably mounted within the housing 16. Manifold 19 is provided with a plurality of apertures 20 disposed in a particular array in the cylindrical wall 21 thereof. However, all of the apertures 20 in manifold 19 are not shown in FIG. 3 in order to simplify the drawing. The manifold 19 is provided with a drive shaft 22 at one end and the other end thereof is urged against the end of housing 16 in a sealed relationship to facilitate rotation yet prevent liquid leakage. The manifold 19 is driven through shaft 22, gears 24 and 25 and motor 26. The motor 26 preferably operates in a stepwise fashion to ensure correct alignment of apertures 20 and conduits 27 in housing 16 which are in fluid communication with nozzle 14. Gear cover 28 is provided to protect the gears 24 and 25 from the harsh environment characteristic of most rolling mills.

Sealing means 29 having apertures 30 for each nozzle or cluster of nozzles 14 are provided between the exterior surface 32 of cylindrical wall 21 and the inner surface 31 of housing 16. The sealing means 29 prevents unwanted leakage of liquid to nozzles 14 which should be closed yet allows passage of liquid from inner chamber 33 defined by manifold 19 through conduits 27 to the nozzles 14 desired.

Figure 6:
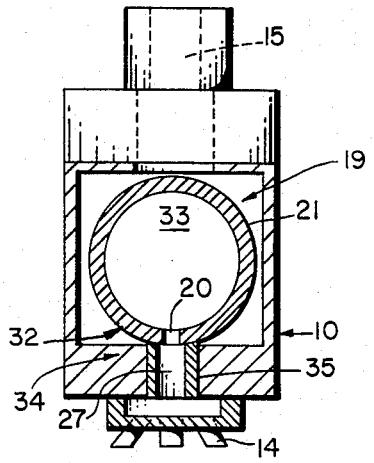
FIG. 6 is the same cross sectional view shown in FIG. 5 of another embodiment of the invention.

An alternate sealing means 34 shown in FIG. 6 comprises a cylindrical tube 35 of appropriate material; which lines a conduit 27 leading to its associated nozzles 14 and the end 36 of tube 35 which is urged against the exterior surface 32 of cylindrical wall 21. The conduit 27 lined with a tube 35 provides a leak-free passageway for fluid from the chamber 33 within manifold 19 to the nozzles 14.

Figure 7:
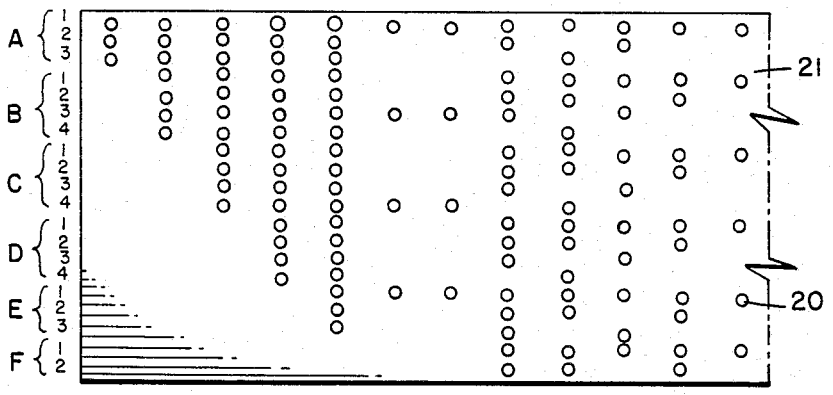
FIG. 7 illustrates the cylindrically shaped wall of the manifold which has been slit longitudinally and spread out or flattened.

As shown more completely in FIG. 7 in which the cylindrical wall 21 of manifold 19 is illustrated as being slit longitudinally and flattened, the wall 21 is provided with an array of apertures 20 so that, when the manifold 19 is rotated about its longitudinal axis, the appropriate apertures 20 can be aligned with apertures 30 in the sealing means or element 29 and conduits 27 in the housing 16 and liquid may be thereby directed from chamber 33 to nozzles 14.

The particular view shown in FIG. 7 is provided in order to illustrate the array of apertures 20 in the cylindrical wall 21. Only half the length of the cylindrical wall 21 is shown in this drawing because the other half would be the mirror image of the first half. All apertures 20 shown in FIG. 7 have the same diameter, but in some instances it may be desirable to increase (or decrease) the diameter of certain apertures 20 to increase (or decrease) liquid flow to a particular nozzle or group of nozzles 14. However, the diameters are chosen to allow the passage of liquid to the nozzles without significant pressure drop so there is no undesirable differences in coolant flow from the various nozzles. A slot can replace several apertures adjacent to one another.

Figure 8:
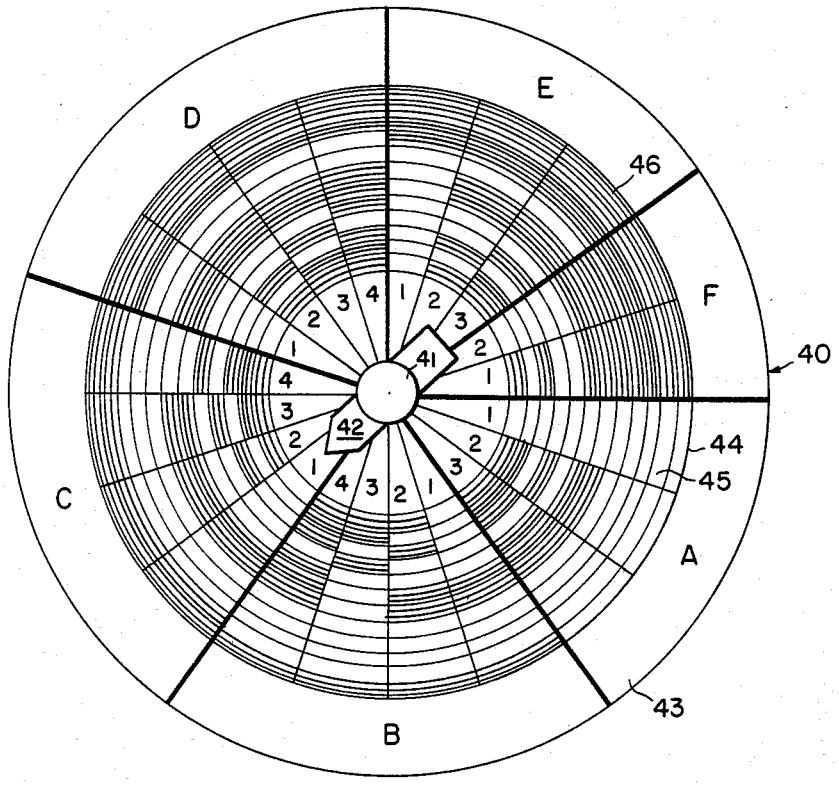
FIG. 8 represents a dial for selecting various liquid application arrangements. In the drawings all corresponding parts are numbered the same.

FIG. 8 represents a control panel face 40 with a selector knob 41 and a pointer 42. Each pie shaped sector 43 of the circular control panel face 40 represents a spray width, with the spray width dimensions decreasing clockwise from Sector A through Sector F. The sectors 43 are divided into subsectors 44 which represents the particular combination of opened or closed nozzles which give the desired spray pattern. Each of the annular segments 45 of subsectors 44 represents a particular nozzle or cluster of nozzles 14. The shaded segments 46 indicate which of the nozzles 14 have been blocked off by the manifold wall 21. The nozzle grouping shown is only one-half of the spray bar because the other half would merely be the mirror image of the first half. All twelve apertures 20 in the manifold wall 21 shown in FIG. 7 are represented in the control panel face 40 shown in FIG. 8.

In the operation of the spray bar 10 the selector knob 41 and pointer 42 are turned to a particular subsector 44 which represents the desired combination of opened and closed nozzles 14. Motor 26, through gears 24 and 25, rotates the manifold 19 in response thereto by means not shown to position the manifold so that the apertures 20 are in alignment with the nozzles 14 which are to discharge liquid while the nozzles 14 which are not to discharge liquid are blocked off by the cylindrical wall 21.

The coolant/lubricant requirements can vary during the rolling process so several combinations (i.e. sections of subsectors 44) of sprays may be required to provide the desired cooling. For example, at the start of rolling a strip width represented by Sector A when the work rolls and backup rolls may not be at operating temperatures, Subsector A(3) would be selected to allow the work rolls to heat up and to develop the appropriate thermal expansion. The outside five nozzles on both sides and the fourth nozzle from the center on both sides are turned on. When the desired roll shape is developed for normal operation the selector knob 41 may be changed to subsector A(2) which causes the liquid flow from the fourth nozzles from the center (both sides) to terminate and flow from the third and fifth nozzles from the center to commence. During the normal rolling process, edge waviness or center or quarter buckles may appear in the workpiece indicating that undesirable thermal expansion has occurred in the mill rolls. The application of coolant/lubricant must be changed to minimize the undesirable expansion. When center buckle appears, for example, the problem may be minimized by changing the selector knob 41 to subsector A(1) which opens up all nozzles for coolant/lubricant flow. When the width of the sheet changes and the mill rolls are more or less at operating temperature levels, the selection of the particular subsector for initial operation may be bypassed and the subsector for normal operations for the particular workpiece width can be selected first.

I claim:

1. In a rolling mill having rolls for use in the reduction in thickness of a metal workpiece an improved device for applying liquid to a roll and/or the workpiece comprising (a) an elongated housing provided with a plurality of nozzles for spraying liquid onto a roll and/or the workpiece and having conduits disposed in open fluid communication with the nozzles for directing liquid thereto;

(b) an elongated manifold rotatably mounted within the housing and having an arcuate wall which is provided with a plurality of apertures disposed in a predetermined array, said wall defining at least in part an interior chamber for containing liquid;

(c) sealing means arranged between the conduits disposed in open liquid communication with the nozzles and the outer surface of the arcuate wall of the manifold and providing sealed liquid passageways to the said conduits from the interior of the manifold;

(d) means for directing liquid to the interior chamber of the manifold;

(e) means for effecting the controlled rotation of the manifold within the housing to selectively align certain apertures in the arcuate wall of the manifold with selected conduits in open fluid communication with the nozzles so that liquid can be sprayed from the nozzles onto the rolls and/or the workpiece in a predetermined pattern;

(f) said manifold rotation means including motor means for rotating said manifold and a controlling panel element associated with said motor means and manifold, said controlling panel element being divided into a plurality of pie-shaped sectors, each of which represents a given width of liquid spray, and said sectors being further subdivided into subsections which represent particular combinations of opened and closed nozzles which provide a selected spray width pattern; and (g) means associated with said panel element and motor means for selecting a given controlling panel element sector and thereby effecting a corresponding rotation of the motor means and manifold as determined by the panel element sector selected.

2. The improved liquid applying device of claim 1 wherein the sector subsections of the panel element are arranged to effect a progressive decrease in the spray width dimensions when projected in a clockwise direction and vice versa.

3. The improved liquid applying device of claim 1 wherein the sealing means providing a sealed liquid passageway comprises a sleeve that fits over the manifold wall, said sleeve having a plurality of apertures selectively alignable with the conduits normally in fluid communication with the nozzles.

4. The liquid applying device of claim 1 wherein the motor means is operated to provide stepwise rotation of the manifold about the longitudinal axis thereof.

5. The liquid applying device of claim 1 wherein the manifold has an arcuate wall of uniform thickness along its full length.

* * * * *